US010224646B2

(12) United States Patent
Tang et al.

(10) Patent No.: US 10,224,646 B2
(45) Date of Patent: Mar. 5, 2019

(54) ANTENNA RADIATING ELEMENT AND ANTENNA

(71) Applicant: Huawei Technologies Co., Ltd., Shenzhen (CN)

(72) Inventors: Tao Tang, Munich (DE); Guoqing Xie, Shenzhen (CN); Xiaoqiang Hou, Xi'an (CN)

(73) Assignee: Huawei Technologies Co., Ltd., Shenzhen (CN)

( * ) Notice: Subject to any disclaimer, the term of this patent is extended or adjusted under 35 U.S.C. 154(b) by 246 days.

(21) Appl. No.: 14/998,304

(22) Filed: Dec. 24, 2015

(65) Prior Publication Data

US 2016/0134026 A1 May 12, 2016

Related U.S. Application Data

(63) Continuation of application No. PCT/CN2013/078152, filed on Jun. 27, 2013.

(51) Int. Cl.
*H01Q 21/26* (2006.01)
*H01Q 21/24* (2006.01)
(Continued)

(52) U.S. Cl.
CPC ..... *H01Q 21/26* (2013.01); *H01Q 1/246* (2013.01); *H01Q 5/385* (2015.01); *H01Q 5/49* (2015.01);
(Continued)

(58) Field of Classification Search
CPC ..... H01Q 21/26; H01Q 19/10; H01Q 21/24; H01Q 1/12; H01Q 3/44
(Continued)

(56) References Cited

U.S. PATENT DOCUMENTS 2,661,423 A * 12/1953 Middlemark ..... H01Q 3/44 343/797
7,692,601 B2 * 4/2010 Bisiules ..... H01P 5/103 343/797
(Continued)

FOREIGN PATENT DOCUMENTS

CN 1906805 A 1/2007
CN 201117803 Y 9/2008
(Continued)

*Primary Examiner* — Hai Tran
(74) *Attorney, Agent, or Firm* — Slater Matsil, LLP

(57) ABSTRACT

The present invention discloses an antenna radiating element and an antenna, where the antenna radiating element includes a pair of crosswise disposed dipoles and parasitic element assemblies; the parasitic element assembly is disposed in an included angle formed by two neighboring dipole arms of the crosswise disposed dipoles; the parasitic element assembly is fastened to the dipole; and a radiation signal transmitted by the dipole is reflected and converged by using the parasitic element assembly. In embodiments of the present invention, the antenna radiating element has a very simple structure, may be directly formed by sheet metal parts, and is convenient to process and manufacture. Also, the parasitic element assembly achieves an effect of reducing a volume of the entire antenna, and therefore both production costs and maintenance costs are reduced.

20 Claims, 3 Drawing Sheets

(51) Int. Cl.

| | |
|---|---|
| ***H01Q 15/14*** | (2006.01) |
| ***H01Q 1/24*** | (2006.01) |
| ***H01Q 9/16*** | (2006.01) |
| ***H01Q 9/28*** | (2006.01) |
| ***H01Q 9/36*** | (2006.01) |
| ***H01Q 19/10*** | (2006.01) |
| ***H01Q 21/29*** | (2006.01) |
| ***H01Q 5/385*** | (2015.01) |
| ***H01Q 5/49*** | (2015.01) |

(52) U.S. Cl.
CPC ..... *H01Q 9/16* (2013.01); *H01Q 9/285* (2013.01); *H01Q 9/36* (2013.01); *H01Q 15/14* (2013.01); *H01Q 19/10* (2013.01); *H01Q 19/108* (2013.01); *H01Q 21/24* (2013.01); *H01Q 21/29* (2013.01)

(58) Field of Classification Search
USPC ..... 343/797
See application file for complete search history.

(56) References Cited

U.S. PATENT DOCUMENTS

| | | | | |
|---|---|---|---|---|
| 2005/0253769 | A1* | 11/2005 | Timofeev ..... | H01Q 1/246 343/797 |
| 2006/0038734 | A1 | 2/2006 | Shtrom et al. | |
| 2009/0096700 | A1 | 4/2009 | Chair | |
| 2010/0321254 | A1 | 12/2010 | Chang | |
| 2012/0146872 | A1 | 6/2012 | Chainon et al. | |
| 2015/0070243 | A1 | 3/2015 | Kish et al. | |

FOREIGN PATENT DOCUMENTS

| | | | | |
|---|---|---|---|---|
| CN | 101505007 | A | | 8/2009 |
| CN | 102377007 | A | * | 3/2012 |
| CN | 102804495 | A | | 11/2012 |
| CN | 202839945 | U | | 3/2013 |
| JP | 2013046331 | A | | 3/2013 |

* cited by examiner

ANTENNA RADIATING ELEMENT AND ANTENNA

This application is a continuation of International Application No. PCT/CN2013/078152, filed on Jun. 27, 2013, which is hereby incorporated by reference in its entirety.

TECHNICAL FIELD

The present invention relates to the electronics field, and in particular, to an antenna radiating element and an antenna.

BACKGROUND

An antenna is an energy conversion apparatus in a mobile communications system. An electromagnetic wave signal transmitted by a mobile station is converted, by using an antenna, into an electrical signal for processing by a base station. Reversely, the base station converts, by using the antenna, the electrical signal into the electromagnetic wave signal for propagation in free space, so that the mobile station can randomly receive the electromagnetic wave signal, thereby implementing bidirectional communication of the communications system. An important tendency in development of a base station antenna is miniaturization, but a width of the antenna directly affects control of a beam width on a horizontal plane by the antenna. To reach a specified performance indicator, a particular width and volume are usually required. Therefore, appropriately increasing the width of the antenna better helps the antenna control the beam width on the horizontal plane to an appropriate value, thereby increasing an antenna gain and obtaining a best coverage effect.

An antenna radiating element is generally disposed on an antenna, and signal radiation is performed by using the antenna radiating element. Currently, a commonly used antenna radiating element is a standard opposed element. There are two pairs of dipoles in a radiation direction of the element, and feeding is performed in an equal amplitude and cophase manner. The dipole is a standard half-wave dipole, and uses a coaxial line to perform feeding. The antenna has a large caliber area, and radiation efficiency is relatively high.

In a process of implementing the embodiments of the present invention, the prior art has at least the following problems:

Currently, a structure and composition of a commonly used antenna radiating element are relatively complex. To ensure specific use strength, die-casting integrated forming is usually selected as a forming process of the antenna radiating element, thereby causing a great difficulty in forming the antenna radiating element, a difficulty in processing and manufacturing, and relatively high costs for production and maintenance.

SUMMARY

To resolve a problem of a complex structure, a great difficulty in forming, and relatively high costs in the prior art, embodiments of the present invention provide an antenna radiating element and an antenna. The technical solutions are as follows:

According to a first aspect, an antenna radiating element is provided, where the antenna radiating element includes a pair of crosswise disposed dipoles and parasitic element assemblies; the parasitic element assembly is disposed in an included angle formed by two neighboring dipole arms of the crosswise disposed dipoles; the parasitic element assembly is fastened to the dipole; and a radiation signal transmitted by the dipole is reflected and converged by using the parasitic element assembly.

In a first possible implementation manner of the first aspect, the parasitic element assembly includes at least one pair of external parasitic elements, where the at least one pair of the external parasitic elements are symmetrically disposed on two sides at a periphery of the dipole.

With reference to the first possible implementation manner of the first aspect, in a second possible implementation manner of the first aspect, the external parasitic element is a ring-shaped and non-closed metal wire.

With reference to the second possible implementation manner of the first aspect, in a third possible implementation manner of the first aspect, the metal wire has an opening facing the dipole.

With reference to the third possible implementation manner of the first aspect, in a fourth possible implementation manner of the first aspect, both ends of the metal wire are symmetrically bent three times in a direction towards the dipole, and tails of both ends of the metal wire are parallel to a plane on which the dipole is located.

With reference to the third possible implementation manner of the first aspect, in a fifth possible implementation manner of the first aspect, both ends of the metal wire are symmetrically bent three times in a direction towards the dipole, and tails of both ends of the metal wire are perpendicular to a plane on which the dipole is located.

With reference to the first possible implementation manner of the first aspect, in a sixth possible implementation manner of the first aspect, the parasitic element assembly further includes a top parasitic element, where the top parasitic element is fastened in parallel with and above the dipole, and the top parasitic element is configured to reflect and converge the signal transmitted by the dipole.

With reference to the first aspect and the first to the sixth possible implementation manners of the first aspect, in a seventh possible implementation manner of the first aspect, the dipole is a half-wave symmetrical dipole.

With reference to the seventh possible implementation manner of the first aspect, in an eighth possible implementation manner of the first aspect, the dipole performs feeding in a coupling manner.

According to a second aspect, an antenna is provided, where the antenna includes a reflection panel and multiple antenna radiating elements, and the antenna radiating elements are all disposed on the reflection panel.

The technical solutions provided in the embodiments of the present invention bring the following beneficial effects:

In the embodiments of the present invention, an antenna radiating element can be formed by additionally disposing parasitic element assemblies around a pair of crosswise disposed dipoles. The antenna radiating element has a very simple structure, may be directly formed by sheet metal parts, and is convenient to process and manufacture. In the embodiments of the present invention, the parasitic element assembly performs secondary reflection and convergence on a radiation signal transmitted by the dipole, so as to generate new radiation, which helps expand a caliber of an original dipole, thereby converging a beam width of an entire antenna on a horizontal plane. This achieves an effect of reducing a volume of the entire antenna, the antenna has a simple structure and a light weight, and therefore both production costs and maintenance costs are reduced.

BRIEF DESCRIPTION OF THE DRAWINGS

To describe the technical solutions in the embodiments of the present invention more clearly, the following briefly introduces the accompanying drawings required for describing the embodiments. Apparently, the accompanying drawings in the following description show merely some embodiments of the present invention, and a person of ordinary skill in the art may still derive other drawings from these accompanying drawings without creative efforts.

Where:

1 represents a dipole;

11 represents a dipole arm;

2 represents a parasitic element assembly;

21 represents an external parasitic element;

211 represents a tail; and

22 represents a top parasitic element.

DETAILED DESCRIPTION OF ILLUSTRATIVE EMBODIMENTS

To make the objectives, technical solutions, and advantages of the present invention clearer, the following further describes the embodiments of the present invention in detail with reference to the accompanying drawings.

Embodiment 1

Figure 1:
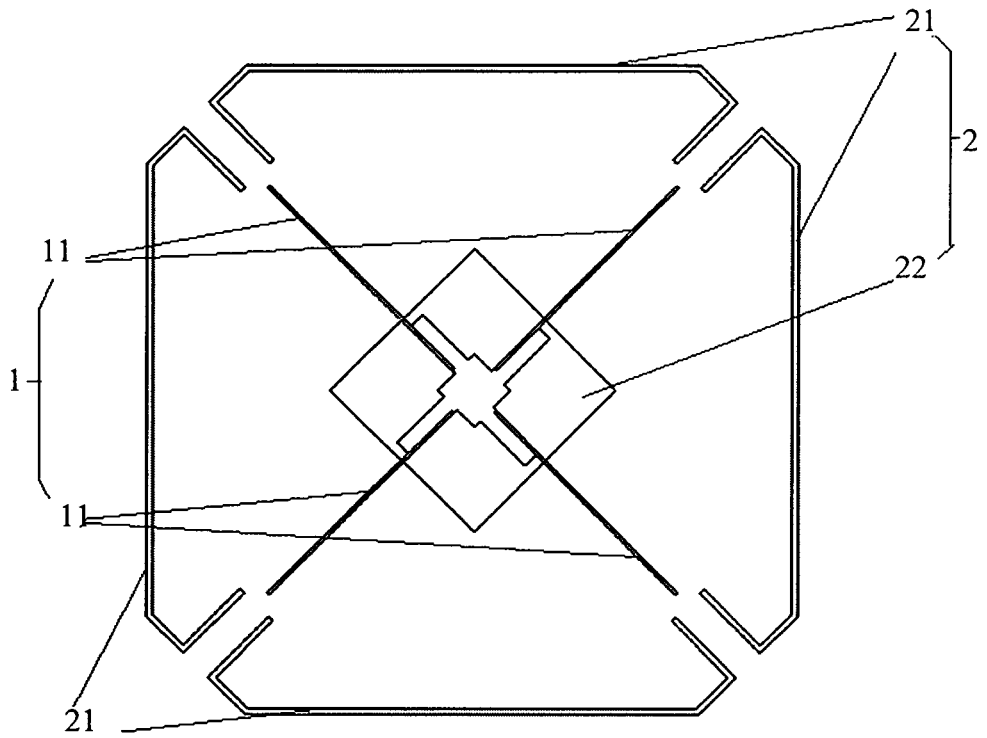
FIG. 1 is a top view of an antenna radiating element according to an embodiment of the present invention.

As shown in FIG. 1, this embodiment of the present invention provides an antenna radiating element, where the antenna radiating element includes a pair of crosswise disposed dipoles 1 and parasitic element assemblies 2; the parasitic element assembly 2 is disposed in an included angle formed by two neighboring dipole arms 11 of the crosswise disposed dipoles 1; the parasitic element assembly 2 is fastened to the dipole 1; and a radiation signal transmitted by the dipole 1 is reflected and converged by using the parasitic element assembly 2.

The parasitic element assembly 2 generally uses a metallic material. It is ensured that the parasitic element assembly 2 is disposed within a range of the included angle formed by the two neighboring dipole arms 11 after crossing of the dipoles 1. Specific high/low and left/right positions of the parasitic element assembly 2 may be appropriately adjusted according to an actual requirement. In this embodiment of the present invention, an antenna radiating element can be formed by additionally disposing the parasitic element assemblies 2 around a pair of the crosswise disposed dipoles 1. The antenna radiating element has a very simple structure, may be directly formed by sheet metal parts, and is convenient to process and manufacture. In this embodiment of the present invention, the parasitic element assembly 2 performs secondary reflection and convergence on a radiation signal transmitted by the dipole 1, so as to generate new radiation, which helps expand a caliber of an original dipole 1, thereby converging a beam width of an entire antenna on a horizontal plane. This achieves an effect of reducing a volume of the entire antenna, the antenna has a simple structure and a light weight, and therefore both production costs and maintenance costs are reduced.

As shown in FIG. 1, specifically and preferably, the parasitic element assembly 2 includes at least one pair of external parasitic elements 21, where the at least one pair of the external parasitic elements 21 are symmetrically disposed on two sides at a periphery of the dipole 1. Such symmetrical disposing of the external parasitic elements 21 makes it convenient for the external parasitic elements 21 to converge the radiation signal transmitted by the dipole 1, which brings a better radiation effect.

As shown in FIG. 1, further, the external parasitic element 21 is a ring-shaped and non-closed metal wire. The ring-shaped and non-closed metal wire has a better conductivity, which is convenient for adjusting a direction of a current passed through, and prevents mutual offset of currents, thereby facilitating secondary reflection of the radiation signal.

As shown in FIG. 1, still further, the metal wire has an opening facing the dipole 1. The metal wire has an opening facing the dipole 1, so that a radiation signal that undergoes secondary reflection performed by the metal wire and the radiation signal generated by the dipole 1 may be superimposed, thereby achieving an effect of helping expand a caliber of the original dipole 1.

Multiple external parasitic elements 21 may be disposed according to an actual requirement; generally and preferably, four external parasitic elements 21 are disposed and are respectively disposed around the dipoles 1. That is, one external parasitic element 21 is disposed between neighboring crossed dipole arms 11 of the dipoles 1; generally, the external parasitic element 21 uses the ring-shaped and non-closed metal wire with a strong conductivity. To ensure performance of reflection and convergence of the metal wire on the radiation signal, the opening of the metal wire needs to face a crossing point of the dipoles 1. Therefore, both ends of the metal wire are bent inwards, and a bending form of the metal wire may be that both ends are bent in a specific angle or an arc, are consecutively bent twice, or are bent multiple times according to an actual requirement, for example, tails of the metal wire after being bent may be parallel or perpendicular to a plane on which the dipole 1 is located, thereby helping expand bandwidth to some extent.

Figure 2:
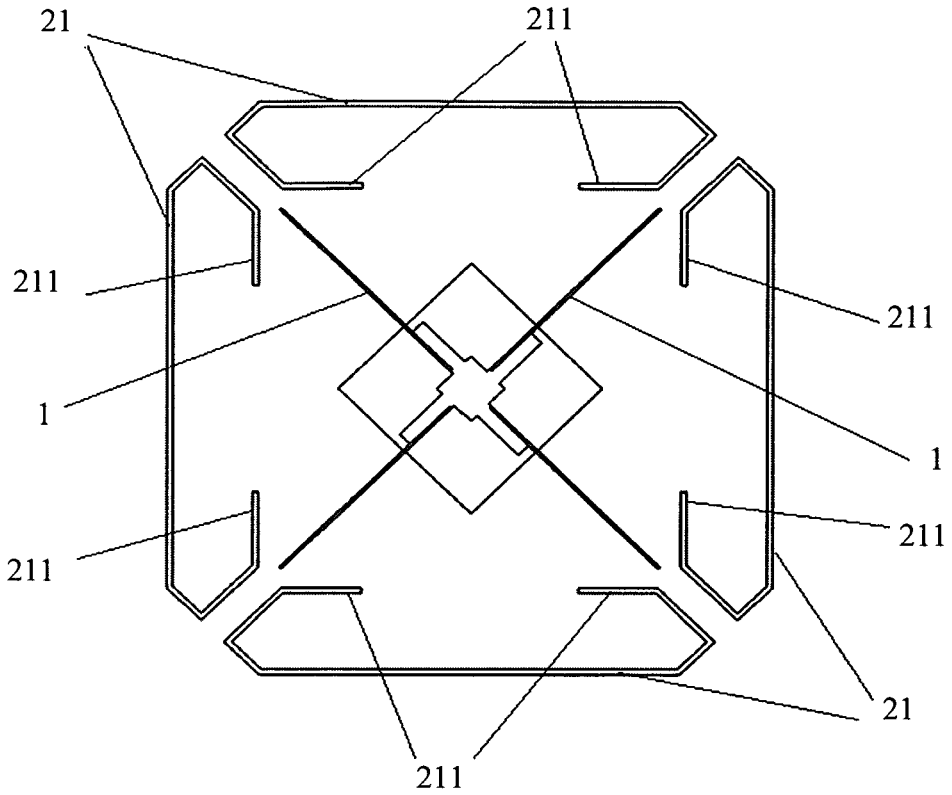
FIG. 2 is a top view of an antenna radiating element according to still another embodiment of the present invention.

As shown in FIG. 2, preferably, both ends of the metal wire are symmetrically bent three times in a direction towards the dipole 1, and tails 211 of both ends of the metal wire are parallel to the plane of the dipole 1.

Figure 3:
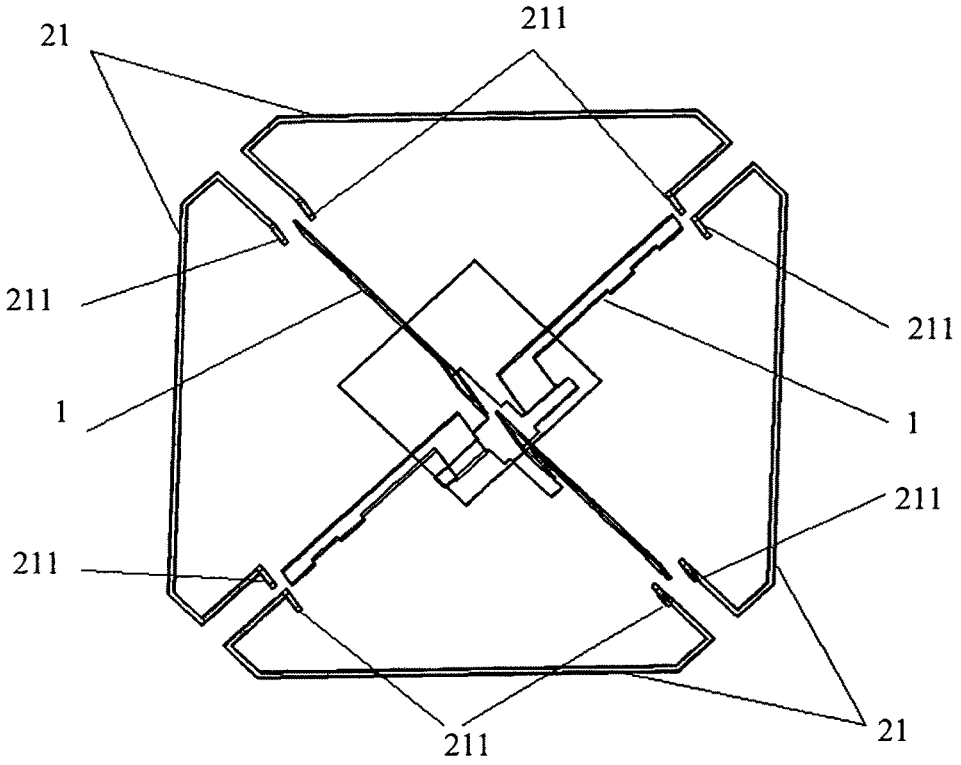
FIG. 3 is a top view of an antenna radiating element according to still another embodiment of the present invention.

As shown in FIG. 3, preferably, both ends of the metal wire are symmetrically bent three times in a direction towards the dipole, and tails 211 of both ends of the metal wire are perpendicular to the plane of the dipole 1.

Other variations may also be made on both ends of the metal wire according to an actual requirement, for example, a change of bending times and a change of a bending angle, which all belong to structure variations in the concept of the present invention. In an actual application, metal wires of these variational structures can all play a positive role in expanding bandwidth.

Figure 4:
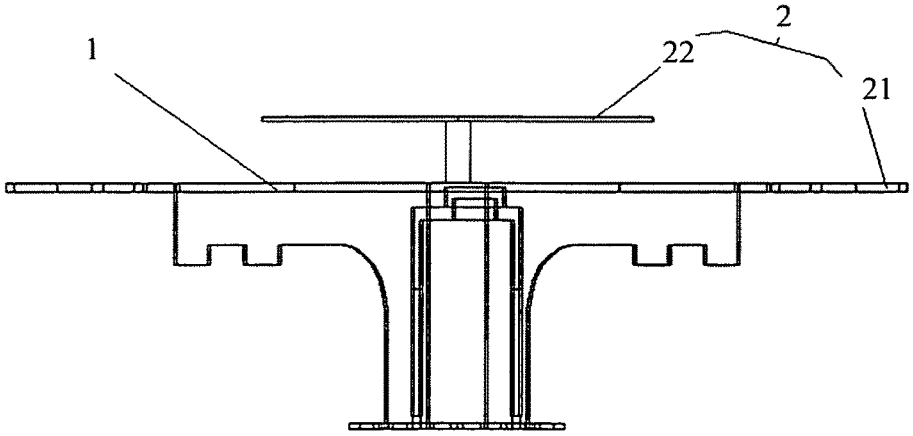
FIG. 4 is a front view of an antenna radiating element according to still another embodiment of the present invention.

As shown in FIG. 4, or reference may be made to FIG. 1, preferably, the parasitic element assembly 2 further includes a top parasitic element 22, where the top parasitic element 22 is fastened in parallel with and above the dipole 1; the top parasitic element 22 is configured to reflect and converge the radiation signal transmitted by the dipole 1; and the top parasitic element 22 uses a sheet-like metallic material and has better reflection performance.

As shown in FIG. 4, or reference may be made to FIG. 1, preferably, the dipole 1 is a half-wave symmetrical dipole 1. The crossed dipoles 1 used in embodiments of the present invention may also be deformed half-wave symmetrical dipoles 1; for example, the dipole arm 11 connected to balun is a circle or a polygon, which facilitates signal radiation.

Further, the dipole 1 performs feeding in a coupling manner.

In this embodiment of the present invention, the metallic external parasitic elements 21 are added around the dipoles 1, so as to perform reflection and convergence on a radiation signal transmitted by the dipole 1, which can achieve a 65-degree beam width; in addition, the dipole 1 performs feeding in the coupling manner, thereby saving electroplating.

Embodiment 2

This embodiment of the present invention provides an antenna, where the antenna includes a reflection panel and multiple antenna radiating elements, and the antenna radiating elements are all disposed on the reflection panel.

The antenna radiating element in this embodiment of the present invention has a same structure as the antenna radiating element in the foregoing embodiment, and details are not described herein again. In this embodiment of the present invention, parasitic element assemblies are additionally disposed around a pair of crosswise disposed dipoles, and the parasitic element assembly performs reflection and convergence on a radiation signal transmitted by the dipole, so as to generate new radiation, which helps expand a caliber of an original dipole, thereby implementing that a 65-degree beam width is achieved by using a smaller reflection panel height and width, converging a beam width of the antenna on a horizontal plane, and achieving an effect of reducing a volume of the antenna; in addition, the dipole performs feeding in a coupling manner, which saves electroplating. As a result, a feeding network may be moved to a front side of the reflection panel, thereby reducing thickness of an entire antenna, and further implementing a half redome and intermediate feed technology. The antenna radiating element in embodiments of the present invention has a simple structure, may be directly formed by sheet metal parts, and is convenient to process and manufacture, so that production and maintenance costs are reduced. The antenna has a notable advantage in an actual application.

The sequence numbers of the foregoing embodiments of the present invention are merely for illustrative purposes, and are not intended to indicate priorities of the embodiments.

The foregoing descriptions are merely exemplary embodiments of the present invention, but are not intended to limit the present invention. Any modification, equivalent replacement, and improvement made without departing from the spirit and principle of the present invention shall fall within the protection scope of the present invention.

What is claimed is:

1. An antenna radiating element, comprising:

a pair of dipoles that are disposed crosswise from one another, forming four dipole arms; and a plurality of parasitic element assemblies, the plurality of parasitic element assemblies comprising a plurality of pairs of external parasitic elements;

wherein each external parasitic element in a pair of parasitic external elements is:

disposed between two neighboring dipole arms in the four dipole arms;

separated, without connection, from all of the following: the two neighboring dipole arms, all other dipole arms in the four dipole arms, another parasitic external element in the pair of external parasitic elements, and all other parasitic external elements in the plurality of parasitic element assemblies; and bent into a shape that causes a secondary radiation signal to be generated by the external parasitic element from a reflection and convergence of a first radiation signal transmitted by the pair of dipoles.

2. The antenna radiating element according to claim 1, wherein the pair of external parasitic elements are symmetrically disposed relative to one another on opposing sides of a dipole in the pair of dipoles, or on opposing sides of a dipole arm of a dipole in the pair of dipoles.

3. The antenna radiating element according to claim 1, wherein each external parasitic element in the pair of external parasitic elements is a metal wire that is non-closed.

4. The antenna radiating element according to claim 3, wherein, for each external parasitic element in the pair of external parasitic elements, an opening between both ends of the metal wire faces the two neighboring dipole arms.

5. The antenna radiating element according to claim 4, wherein, for each external parasitic element in the pair of external parasitic elements, both ends of the metal wire are bent symmetrically to one another towards the two neighboring dipole arms, and each of both ends of the metal wire includes a tail portion that is parallel to a plane on which the pair of dipoles are disposed.

6. The antenna radiating element according to claim 4, wherein, for each external parasitic element in the pair of external parasitic elements, both ends of the metal wire are bent symmetrically to one another towards the two neighboring dipole arms, and each of both ends of the metal wire includes a tail portion that is perpendicular to a plane on which the pair of dipoles are disposed.

7. The antenna radiating element according to claim 1, wherein the plurality of parasitic element assemblies further comprises a top parasitic element;

wherein the top parasitic element is fastened in parallel with, and above, the pair of dipoles; and wherein the top parasitic element is bent into a shape that causes the top parasitic element to reflect and converge the first radiation signal transmitted by the pair of dipoles.

8. The antenna radiating element according to claim 1, wherein each dipole in the pair of dipoles is a half-wave symmetrical dipole.

9. The antenna radiating element according to claim 8, wherein the pair of dipoles performs feeding in a coupling manner.

10. The antenna radiating element according to claim 1, wherein the secondary radiation signal is generated by a superimposition on the first radiation signal of a signal obtained from the reflection and convergence of the first radiation signal.

11. The antenna radiating element according to claim 1, wherein the opening faces a crossing point of the pair of dipoles, and faces a spacing that is between a first end of a first dipole arm in the two neighboring dipole arms, and a second end of a second dipole arm in the two neighboring dipole arms.

12. An antenna, comprising:

a reflection panel; and a plurality of antenna radiating elements disposed on the reflection panel;

wherein each antenna radiating element in the plurality of antenna radiating elements comprises a pair of dipoles that are disposed crosswise from one another, forming four dipole arms, and a plurality of parasitic element assemblies;

wherein the plurality of parasitic element assemblies comprises a plurality of pairs of external parasitic elements;

wherein each external parasitic element in a pair of external parasitic elements is:

disposed between two neighboring dipole arms in the four dipole arms;

separated, without connection, from all of the following: the two neighboring dipole arms, all other dipole arms of the four dipole arms, another parasitic external element in the pair of external parasitic elements, and all other parasitic external elements in the plurality of parasitic element assemblies; and bent into a shape that causes a secondary radiation signal to be generated by the external parasitic element from a reflection and convergence of a first radiation signal transmitted by the pair of dipoles.

13. The antenna according to claim 12, wherein the pair of external parasitic elements are symmetrically disposed relative to one another on opposing sides of a dipole in the pair of dipoles, or on opposing sides of a dipole arm of a dipole in the pair of dipoles.

14. The antenna according to claim 12, wherein each external parasitic element in the pair of external parasitic elements is a metal wire that is non-closed.

15. The antenna according to claim 14, wherein, for each external parasitic element in the pair of external parasitic elements, an opening between both ends of the metal wire faces the two neighboring dipole arms.

16. The antenna according to claim 15, wherein , for each external parasitic element in the pair of external parasitic elements, both ends of the metal wire are bent symmetrically to one another towards the two neighboring dipole arms, and each of both ends of the metal wire includes a tail portion that is parallel to the reflection panel.

17. The antenna according to claim 15, wherein, for each external parasitic element in the pair of external parasitic elements, both ends of the metal wire are bent symmetrically to one another towards the two neighboring dipole arms, and each of both ends of the metal wire includes a tail portion that is perpendicular to the reflection panel.

18. The antenna according to claim 12, wherein the parasitic element assemblies further comprises a top parasitic element;

wherein the top parasitic element is fastened in parallel with and above the pair of dipoles; and wherein the top parasitic element is bent into a shape that causes the top parasitic element to reflect and converge the first radiation signal transmitted by the pair of dipoles.

19. The antenna according to claim 12, wherein each dipole in the pair of dipoles is a half-wave symmetrical dipole.

20. The antenna according to claim 19, wherein the pair of dipoles performs feeding in a coupling manner.

* * * * *